United States Patent [19]

Arnaudeau

[11] 4,365,932

[45] Dec. 28, 1982

[54] PUMPING DEVICE FOR DIPHASIC FLUIDS

[75] Inventor: Marcel Arnaudeau, Paris, France

[73] Assignee: Institut Francais du Petrole, Rueil-Malmaison, France

[21] Appl. No.: 217,294

[22] Filed: Dec. 17, 1980

[30] Foreign Application Priority Data

Dec. 17, 1979 [FR] France ..... 79 31031

[51] Int. Cl.[3] ..... F04D 19/02

[52] U.S. Cl. ..... 415/199.5; 415/74; 415/213 C; 415/215

[58] Field of Search ..... 415/72, 74, 199.4, 199.5, 415/207, 213 C, 215

[56] References Cited

U.S. PATENT DOCUMENTS 3,784,321 1/1974 Woell, Jr. ..... 416/223 R

FOREIGN PATENT DOCUMENTS 447809 7/1927 Fed. Rep. of Germany ... 415/199.5

29522 of 1907 United Kingdom ..... 415/199.5

*Primary Examiner*—Harvey C. Hornsby

*Assistant Examiner*—Christine A. Peterson

*Attorney, Agent, or Firm*—Millen & White

[57] ABSTRACT

This device relates to a pump for diphasic fluids and comprises an impeller having a hub which carries blades of a special design. The intersection of the outer surface of each blade with a cylindrical surface coaxial with the hub is a line whose angle of inclination, relative to a plane perpendicular to the hub axis, has a substantially constant value over about one third of the hub length. Furthermore, the intersection of the inner surface of each blade with said cylindrical surface forms a curve, or profile, which can be divided into four successive portions with different law of variations of the angle of inclination of this profile relative to a plane perpendicular to the hub axis.

14 Claims, 8 Drawing Figures

PUMPING DEVICE FOR DIPHASIC FLUIDS

BACKGROUND OF THE INVENTION

The present invention relates to a pumping device for diphasic fluids i.e. fluids which, at the intake of the device, under the prevailing pressure and temperature conditions, are formed of a mixture of a liquid with a gas which is not dissolved in the liquid, the liquid being or not being gas-saturated.

Pumping a diphasic fluid, for example, but not exclusively, a diphasic oil effluent formed by a mixture of liquid and gas raises problems which become more difficult with increasing values of the volumetric gas-to-liquid ratio under the thermodynamic conditions prevailing in the diphasic fluid at the inlet of the pumping device.

With reference to the above the volumetric gas-to-liquid ratio, which is briefly referred to in the following as the "volumetric ratio", is defined as the ratio of the volume of fluid in the gaseous state to the volume of fluid in the liquid state, the value of this ratio depending on the thermodynamic conditions of the diphasic fluid.

Irrespective of the design of the pumps used (alternating, rotary pumps, or pumps with suction effect), good results are obtained for a zero value of the volumetric ratio, since the fluid is then equivalent to a monophasic liquid fluid. Such pumping devices can still be used as long as the operating conditions do not lead to phenomena which are likely to vaporise a large fraction of the gas dissolved in the liquid, or when the value of the volumetric ratio at the intake of the pump is at most equal to 0.2. Experience shows that, beyond this value, the efficiency of these devices decreases very rapidly, so that they can no longer be practically used.

In order to improve the operation of existing pumping devices, the gaseous phase can be separated from the liquid phase before the pumping operation, and each of these phases is then separately processed in distinct pumping circuits. The use of such separate pumping circuits is not always possible and in any event makes the pumping operations more difficult.

Therefore, an attempt has been made to develop pumping devices which are not only adapted to increase the overall energy of the pumped diphasic fluid, but are also capable of producing a diphasic fluid having a volumetric ratio at the outlet of the device of a lower value than that of the fluid at the inlet.

Thus several designs of impeller blades have been described, for example in U.S. Pat. Nos. 3,299,821 and 3,951,565 and in French Patent Applications No. 2,157,437 and 2,333,139.

SUMMARY OF THE INVENTION

The present invention provides a device using blades of a particular design which increases the pumping efficiency for the diphasic fluids having a volumetric ratio higher than 0.2. More particularly, the device according to the invention makes it possible to pump diphasic fluids having a volumetric ratio which may reach or exceed 1.2 with an efficiency rate which may be greater than 60%.

BRIEF DESCRIPTION OF THE DRAWINGS

All the advantages of the device according to the invention, which is of simple design and strong construction and is economically attractive, will become apparent from the following description illustrated by the accompanying drawings wherein.

DETAILED DISCUSSION OF THE INVENTION

In the following description the term "fluid" will be used to designate either a liquid monophasic fluid in which a gas is completely dissolved, or a diphasic fluid comprising a liquid phase and a gaseous phase.

Figure 1B:
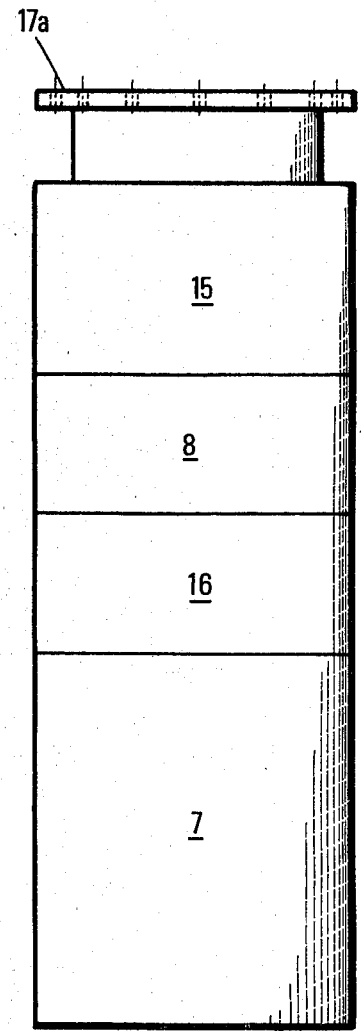
FIG. 1B is a side elevation view of the driving assembly attachable to the device of FIG. 1A for controlling the operation of the device.
Figure 1A:
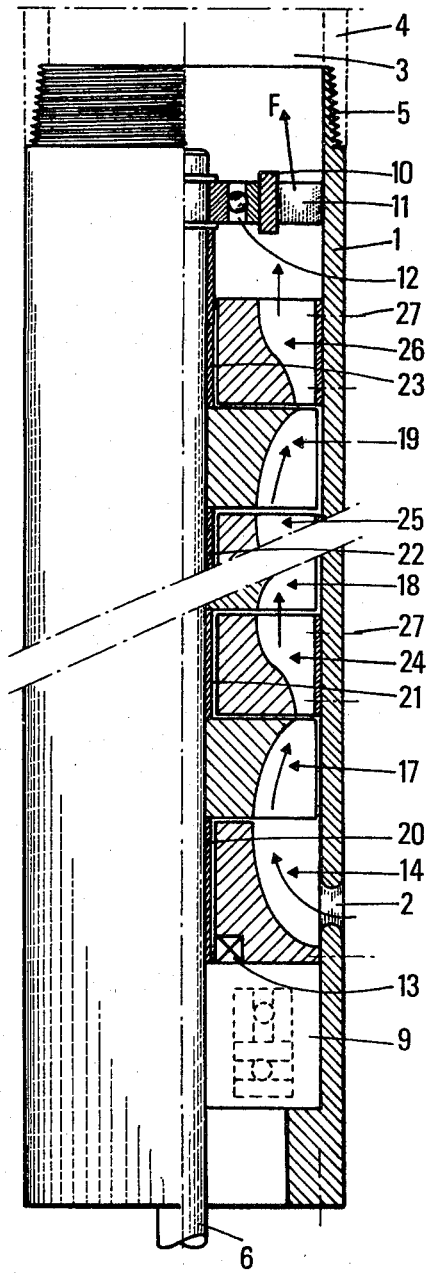
FIG. 1A diagrammatically illustrates in partial axial cross-section a specific embodiment of a device according to the invention used for pumping the diphasic effluent from a well.

FIG. 1 diagrammatically shows in partial axial cross-section a non-limitative embodiment of a device according to the invention adapted to pump a diphasic hydrocarbon effluent.

The design of this device is adapted to conventional drilling equipment and it can be introduced at the bottom of a producing oil well.

This pumping device comprises a hollow casing 1 which, in this embodiment, is of cylindrical shape, so as to be easily introduced into a well. The casing 1 is provided with at least one inlet orifice 2 for diphasic fluid and with at least one outlet orifice 3 connected to the flow or discharge circuit of the pumped fluid, this circuit being diagrammatically illustrated as a pipe 4 at one end of which the casing 1 is secured by any suitable means, such as the threading shown at 5.

In the embodiment illustrated in FIG. 1 the inlet orifices 2 are formed by apertures through the wall of the casing 1 and the pumping device comprises at the level of these apertures a deflector 14 integral with the casing so as to deflect the flow after the fluid has entered the casing and to give this fluid a substantially axial flow direction, i.e. a flow direction substantially parallel to the pump axis.

Within the casing is located a rotor whose shaft 6 is connected to driving means 7, such as, but not limited to, an electric motor whose power supply cables have not been shown and, optionally, a transmission element, diagrammatically shown at 8, to adapt the speed of rotation of the driving shaft to the speed at which the shaft 6 must be rotated.

The element 8, which may be of any suitable known type and may comprise gears, will not be described in more detail, since its design requires only ordinary skill.

The shaft 6 is held in position by at least two separate bearings 9 and 10.

The first of these bearings, located on the side of the engine 7, comprises at least one axial bearing, such as a ball bearing, capable of withstanding axial stresses exerted on the pumping device, and at least one centering element such as a ball bearing, or a taper-roller or straight roller bearing.

The bearing 10 is secured to the casing 1 by radial arms 11 with, the spaces between these radial arms permitting fluid flow in the direction indicated by the arrow F. Preferably, a ball bearing 12 is positioned between the shaft 6 and the bearing 10. The inner ring or race of this ball bearing is axially displaceable together with the shaft 6, while the external ring or race is axially displacement relative to the bearing, to allow for possible variations in the length of the shaft 6, which may for example result from thermal dilatation.

Optionally, depending on the nature of the pumped fluid, the ball bearing 12 may be a sealed roller bearing, but it is also possible to use an ordinary ball bearing by providing sealing flanges on both sides of the bearing 10, the latter being previously filled with a lubricating material, such as grease, when it is mounted on the device.

The bearing 9 also comprises a sealing device 13 and communicates with a lubricating device 15 comprising, for example, an oil tank having at least a wall portion which is deformable so as to equalize the oil pressure with the hydrostatic pressure at the location of the pumping device.

If necessary, a second oil tank 16 may be provided for the lubrication of the motor 7 and/or of the transmission means 8.

The assembly of the motor means is secured in the extension of the casing 1, for example by means of a connecting flange 17*a*.

Between the inlet and outlet orifices of the pumping device there is provided, inside the casing 1, at least one element, or stage, adapted to increase the overall energy of the fluid. Three stages referenced 17 to 19 can be seen in FIG. 1. The number of stages employed is not limitative and depends on the pressure increase which should be obtained.

These elements or stages, which will be described below in more detail, are integral with the shaft 6 on which they are, for example, forcibly fitted, the spacing between these stages being maintained by means of cross-members 20 to 33.

A flow straightener, such as the flow straightening elements 24 to 26, is preferably located at the outlet of each pressure increasing stage, this straightener being connected to the casing 1, for example by means of securing screws 27 (indicated in mixed lines in the drawing).

For clarity of the drawing, the clearances between cross-members and flow straighteners, those between the pressure increasing stages and the casing as well as the clearances between these stages and the flow straighteners have been exaggerated in the drawing, but it must be understood that these clearances are reduced to the minimum values compatible with the proper operation of the pump, so that fluid leakage is minimized and at the operating temperature no jamming is caused by the expansion of the different components of the pumping device.

Figure 2:
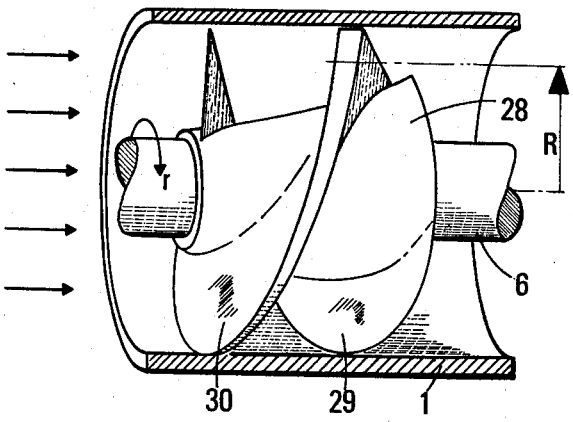
FIG. 2 is a perspective view of an impeller.

FIG. 2 is a perspective view of a non-limitative embodiment of an impeller element or impeller stage which essentially comprises a hub 28 integral with the shaft 6 which, during the operation of the device, is rotated in the direction of the arrow r.

This hub is provided with at least one blade whose characteristics will be set forth below. Two blades 29 and 30 have been illustrated in FIG. 2, but this number is by no way limitative. The blade number is generally selected so as to facilitate static and dynamic balancing of the rotor. The height of the blades is such that the volume defined during their rotation is complementary to the bore of the casing 1 which is cylindrical in the illustrated embodiment.

These blades may be added elements secured by welding to the hub 28, but it is preferable to manufacture such a hub and blade assembly by moulding.

Figure 3A:
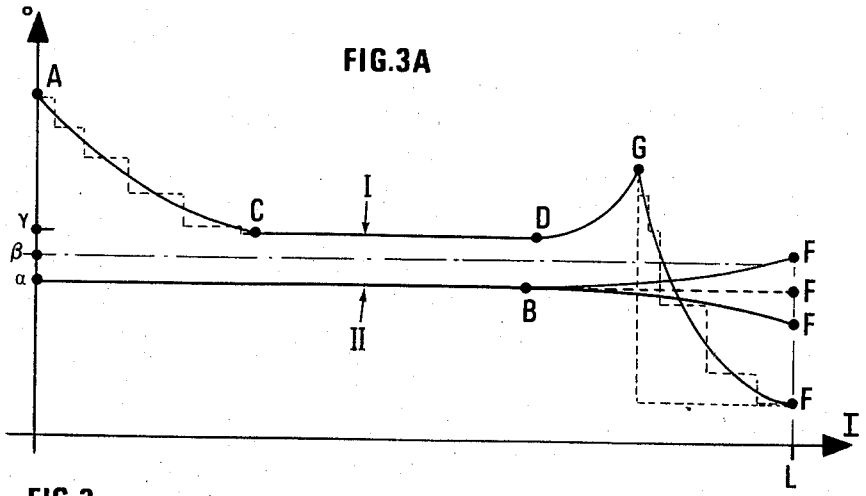
FIG. 3A is a graphical representation showing the variation of the angle of inclination of the inner and outer surfaces of the blade.
Figure 3:
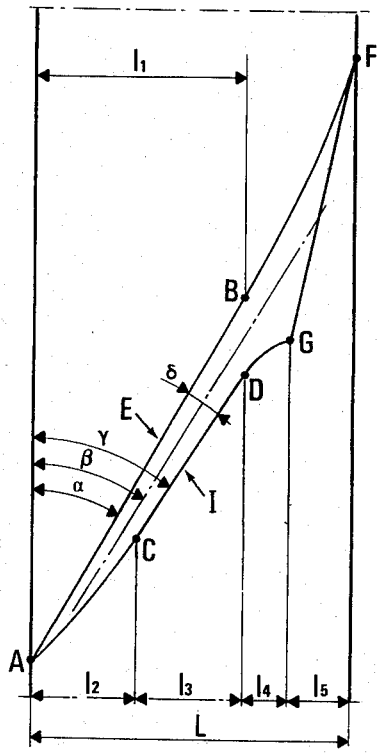
FIG. 3 is a developed view of the line of intersection of an impeller blade with a cylindrical surface.

FIG. 3 represents the developed outline of the intersection of a blade with a cylindrical surface having the radius R. As apparent from this drawing, it has been found that the above-indicated objects of the present invention can be achieved by using a blade whose profile has the following configuration, starting from the leading edge of the blade towards the trailing edge thereof F:

1. the angle of the outer surface E of the blade with a reference plane perpendicular to the rotation axis of the hub has a substantially constant value $\alpha$ throughout a first portion AB of this outer surface, extending over a fraction $l_1$ of the hub which substantially corresponds to two thirds of the length L of the impeller measured parallel to its axis of rotation, whereas on the remaining portion BF of the outer blade surface, the angle of this outer surface relative to the reference plane may either remain constant and equal to the value $\alpha$, or continuously increase or decrease from the value $\alpha$ by a quantity $\Delta\alpha$ which is at most equal to 20% of the value $\alpha$;
2. the angle between the inner surface I of the blade and the reference plane:
   (a) decreases, either continuously or stepwise, from a maximum value at the level of the leading edge A to a value $\gamma$ which is greater than $\alpha$, over a first portion AC of the inner blade surface, corresponding to a length $l_2$ of the hub substantially equal to one third of the overall length L of this hub, this maximum value being at most equal to 150% of the value of the angle $\gamma$,
   (b) is substantially constant and equal to the value $\gamma$ over a second portion CD of the inner blade surface following said first portion and corresponding to a length $l_3$ of the hub of 30 to 40% of the overall length L of this hub,
   (c) then continuously increases from the value $\gamma$ to a maximum value at most equal to $2\gamma$ over a third portion DG of the inner blade surface, corresponding to a length $l_4$ of the hub of 10 to 20% of the overall length of this hub, and then
   (d) is such over the remaining portion of the inner blade surface that the respective profiles of the inner and outer surfaces of the blade intersect each other on the trailing edge F of the blade; and
3. the angle formed between the first portion of the outer blade surface E and the second portion of the inner blade surface I has a value $\delta$ comprised between 0° and 10° and preferably close to 3°, while the bisectrix of this angle forms with the reference plane an angle defined by the relationship:

$$\tan \beta \simeq \frac{\omega R}{V_z}$$

where $\omega$ is the angular rotation speed of the hub expressed in radian/second, R (in meter) is the cylinder radius whereon the trace of the blade is defined, and $V_z$ (in meter/second) is the component of the fluid velocity along the rotation axis, or axial velocity, ahead of the impeller stage intake.

The curves I and II of FIG. 3A respectively represent the solution of the respective angles of the inner and outer blade surfaces versus the hub length.

As apparent in this drawing, the angle of the inner blade surface may vary either continuously or stepwise over the first portion AC and the last portion GF of this inner surface.

Similarly over the last portion BF of the outer blade surface the angle may decrease, be constant, or be equal to $\alpha$, or increase.

It is generally preferable to drive the hub at such a rotation speed, that the value of the ratio $$\frac{\omega R}{V_z}$$

does not vary substantially, in spite of the variations of the axial velocity $V_z$ of the fluid at the inlet of the impeller stage.

The length L of the hub is preferably smaller than the maximum radius Rm of the blades measured in the plane passing through the leading edge of the blade and perpendicular to the axis of rotation.

The diameter of the hub 28 may be constant but it will be preferable to use a hub whose diameter increases in the direction of flow of the fluid over at least 80% of its length, as shown in FIG. 2.

The variation of the diameter is selected so that the value of the cross-section defined by two blades in a plane perpendicular to the axis of rotation has a value $S_e$ at the inlet of the impeller, i.e., at the level of the leading edge A, and a value $S_s$ at the outlet of the impeller, i.e., at the level of the trailing edge F, these values being such that the ratio $S_e/S_s$ is at least equal to 1, and is preferably comprised between 2 and 3.

At the outlet of an impeller stage, the fluid velocity has at least an axial component and a circumferential component. As it is well known in the art, the use of a flow straightener permits increasing of the static fluid pressure, while reducing the circumferential component of the fluid flow velocity. This flow straightener may be of any known type whose characteristics are adapted to those of the impeller stage, as indicated below with reference to FIGS. 4 and 5.

Figure 4:
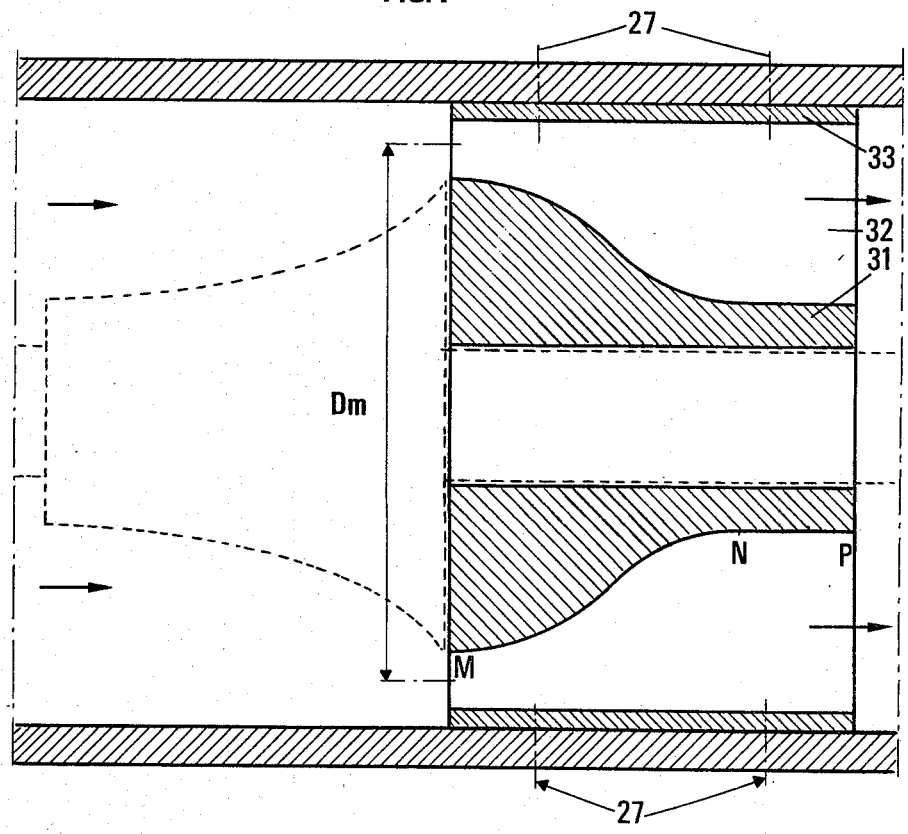

FIG. 4 shows, in cross-section, an assembly comprising an impeller (shown in broken line) and a flow straightener (shown in solid line).

Figure 5:
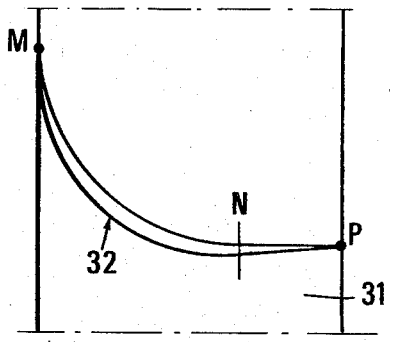
FIGS. 4 and 5 show a flow straightener.

FIG. 5 diagrammatically shows the developed profile of the intersection of the flow straightener with a cylindrical surface whose radius is R.

The flow straightener comprises a sleeve 31 which carries at least two fins 32. A ring 33 secured to the fins 32 permits connecting the flow straightener to the casing 1, for example by means of screws diagrammatically shown at 27.

The external diameter of the sleeve 31 progressively decreases from the inlet to the outlet over a first portion MN which represents at least 30% of the overall length of the flow straightener, measured along a direction parallel to its axis, this overall length being itself equal to at least 30% of the average diameter $D_m$ of the fins at the inlet of the flow straightener. Thus the cross-section of the fluid passageway increases according to a law of the first or second order, when considering the direction of flow indicated by the arrows.

The fins 32 have a profile suitable for adjusting the flow direction. At the inlet of the flow straightener this profile is substantially tangent to the fluid flow, while at the end of the first portion MN the profile of the fins is substantially tangent to a plane passing through the axis of the device, the inclination angle progressively varying along this first portion.

In order to simplify the manufacture of the flow straightener, the first portion MN of the fins is given a constant radius of curvature.

The remaining portion NP of the fins is axially oriented and the hub is cylindrical over this portion.

The inlet cross-section $S_e$ of a flow straightener is larger than the outlet cross-section $S_s$ of the impeller stage located upstream of this flow straightener, so that the ration $S_e/S_s$ has a value comprised between 1 and 1.2, and preferably between 1.1 and 1.15, while the ratio $S_s/S_e$ of cross-sections at the outlet and the inlet of the flow straightener respectively is higher than 1, and preferably comprised between 2 and 3.

In the foregoing there has been assumed a slight axial clearance between the trailing edge of the impeller and the leading edge of the following flow straightener, but it will also be possible to place this impeller and the flow straightener at a distance from each other which will be determined during preliminary tests on the basis of the conditions of use of the device.

Figure 6:
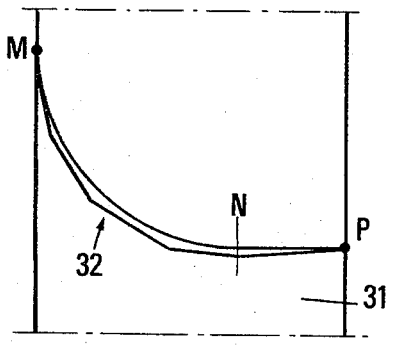
FIG. 6 illustrates another embodiment of a fin of the flow straightener.

Changes may be made without departing from the scope of the present invention. For example, as shown in FIG. 6, the outer surface of each fin of the flow straightener may be formed by machining metal pieces having secant plane wall portions.

In another embodiment of the pumping device, the shaft 6 will work under traction, this shaft being held in position at its upper part by hydrodynamic and/or hydrostatic bearings, all the impellers being locked on this shaft and held in position by cross-members of suitable size and by locking at the lower part of shaft 6.

At intervals, the shaft is held against radial movement by hydrodynamic bearings (at the level of suitably selected flow straightening elements), so that the critical rotation speed of the rotor is higher than the maximum rotation speed of the pump in operation. Lubrication of these bearings is ensured by suitably located oil conduits.

The flow straightener may have "thick" fins in the hydrodynamic sense of this adjective.

In any case, the number of impeller-flow straightener assemblies will be selected in dependence with the value of the volumetric ratio of the pumped fluid.

The above-described device has been designed for use in an oil well and therefore the outer body of the device is of cylindrical shape. However without departing from the scope of the invention there can be used a conical outer casing and/or cylindrical or conical hubs, provided that the above-defined characteristics are complied with.

What is claimed is:

1. A pumping device for a diphasic fluid which comprises a liquid phase and an undissolved gaseous phase, this device comprising at least one hollow casing having inlet and outlet openings for the fluid, at least a rotor rotatably mounted in said casing, said rotor comprising a hub and at least a blade integral with said hub, said blade having a leading edge on the side of said inlet opening and a trailing edge on the side of said outlet opening, wherein a line representing the intersection of the outer surface of said blade with a cylindrical surface coaxial to said hub is inclined relative to a reference plane perpendicular to the rotor axis by a substatially constant angle having a first value throughout a first portion of the outer surface of said blade corresponding to about two thirds of the hub length, the line representing the intersection of the inner surface of said blade with said cylindrical surface having four successive portions, comprising a first portion of the inner blade surface whereon the angle between the profile of the inner blade surface and the reference plane decreases from a second value to a third value greater than said first value, said first portion of the inner blade surface extending over substantially one third of the hub length, said second value being at most equal to 150% of said third value, a second portion of the inner blade surface whereon said angle is substantially constant and equal to said third value, said second portion extending over 30 to 40% of the hub length, a third portion of the inner blade surface whereon said angle continuously increases from said third value to a fourth value at most equal to twice said third value, said third portion extending over 10 to 20% of the hub length, and a fourth portion of the inner blade surface whereon the line of intersection of the inner blade surface with said cylindrical surface is such that the respective profiles of the inner and outer surfaces of the blade intersect each other on the trailing edge of the blade, the difference between said first and third values being comprised between 0° and 10°, the arithmetic average value of said first and second values corresponding to an angle whose trigonometric tangent is substantially equal to $\omega R/V_z$, wherein $\omega$ represents the speed of angular rotation of the hub, R the radius of said cylindrical surface, and $V_z$ the axial flow velocity of the fluid at the level of the leading edge of the blade.

2. A device according to claim 1, wherein on the second portion of the outer blade surface extending over about one third of the hub, said angle between the outer blade surface and said reference plane is constant and equal to said first value.

3. A device according to claim 1, wherein on said second portion of the outer blade surface extending over about one third of the hub, said angle between the outer blade surface and said reference plane continuously varies by a quantity at most equal to ±20% from said first value.

4. A device according to claim 1, wherein the length of said hub, measured parallel to its axis of rotation, is at most equal to the maximum radius of the blades measured in said reference plane.

5. A device according to claim 1, wherein the radius of the rotor hub increases over at least 80% of its length.

6. A device according to claim 1, wherein the ratio between the inlet cross-section defined between two consecutive blades in the reference plane and the outlet cross-section defined in a plane perpendicular to the hub axis and passing through said trailing edge is at least equal to 1.

7. A device according to claim 6, which comprises downstream from said outlet cross-section, with reference to the direction of flow of the fluid, static flow straightening means provided with stationary fins adapted to reduce the circumferential velocity component of the fluid, said stationary fins having, at one end which constitutes their leading edge, a profile substantially tangent to the direction of flow of the fluid, and having at their other end, which constitutes the trailing edge of said stationary fins, a profile which is substantially tangent to the axis of the flow straightening means, wherein the ratio of the cross-section of the fluid passageway measured in a plane perpendicular to said axis and passing through the leading edge of the fins of the flow straightening means to the cross-section of the fluid passageway measured in a plane perpendicular to said axis and passing through the trailing edge of the fins of the flow straightening means has a value comprising between 1 and 1.2.

8. A device according to claim 7, wherein the ratio of the cross-section of the fluid passageway measured in a plane perpendicular to the axis of the flow straightening means and passing through the trailing edge of the fins of this flow straightening means to the cross-section measured in said plane perpendicular to the axis of the flow straightening means and passing through the leading edge of the fins of the flow straightening means has a value greater than 1.

9. A device according to claim 8, wherein the cross-section defined between two consecutive fins of the flow straightening means and measured in a plane perpendicular to the axis of the device progressively increases over at least one third of the length of said flow straightening means starting from the leading edge thereof.

10. A device according to claim 9, wherein the length of the flow straightening means is at least equal to 30% of the average diameter of its fins measured at the level of the leading edge thereof.

11. A device according to claim 1, wherein said difference between said first and third values is about 30.

12. A device according to claim 6, wherein said ratio comprises between 2 and 3.

13. A device according to claim 7, wherein said ratio of the cross-section of the fluid passageway passing through the leading edge to the cross-section of the fluid passageway passing through the trailing edge comprises between 1.1 and 1.15.

14. A device according to claim 8, wherein said ratio comprises between 2 and 3.

* * * * *

UNITED STATES PATENT AND TRADEMARK OFFICE

CERTIFICATE OF CORRECTION

PATENT NO. : 4,365,932

DATED : December 28, 1982

INVENTOR(S) : MARCEL ARNAUDEAU

It is certified that error appears in the above-identified patent and that said Letters Patent is hereby corrected as shown below:

Column 6, line 69: reads "plane perpendicular to the rotor axis by a substatially"
should read -- plane perpendicular to the rotor axis by a substantially --

Column 8, line 44: reads "ference between said first and third values is about 30."
should read --ference between said first and third values is about $3^{o}$--

Signed and Sealed this

Twenty-second Day of March 1983

[SEAL]

Attest:

GERALD J. MOSSINGHOFF

Attesting Officer

Commissioner of Patents and Trademarks